United States Patent [19]

Schmidt et al.

[11] Patent Number: 4,832,738

[45] Date of Patent: May 23, 1989

[54] MOLYBDENUM-COPPER AND TUNGSTEN-COPPER ALLOYS AND METHOD OF MAKING

[75] Inventors: Frederick A. Schmidt; John D. Verhoeven; Edwin D. Gibson, all of Ames, Iowa

[73] Assignee: Iowa State University Research Foundation, Inc., Ames, Iowa

[21] Appl. No.: 93,920

[22] Filed: Sep. 8, 1987

[51] Int. Cl.[4] ..... C22C 9/00

[52] U.S. Cl. ..... 75/10.23; 148/407

[58] Field of Search ..... 75/10.23; 148/407

[56] References Cited

U.S. PATENT DOCUMENTS 3,271,828 9/1966 Shelton ..... 75/10.23
3,341,321 9/1967 Morrison ..... 75/10.23
4,481,030 11/1984 Schmidt et al. ..... 148/407
4,600,448 7/1986 Schmidt et al. ..... 148/407

OTHER PUBLICATIONS

Downing et al., J. Appl. Phys. 61(7):2621-2625.

*Primary Examiner*—Peter D. Rosenberg
*Attorney, Agent, or Firm*—Tilton, Fallon, Lungmus & Chestnut

[57] ABSTRACT

Molybdenum-copper and tungsten-copper alloys are prepared by a consumable electrode method in which the electrode consists of a copper matrix with embedded strips of refractory molybdenum or tungsten. The electrode is progressively melted at its lower end with a superatmospheric inert gas pressure maintained around the liquifying electrode. The inert gas pressure is sufficiently above the vapor pressure of copper at the liquidus temperature of the alloy being formed to suppress boiling of liquid copper.

8 Claims, 4 Drawing Sheets

CALCULATED Cu Mo PHASE DIAGRAM

MOLYBDENUM-COPPER AND TUNGSTEN-COPPER ALLOYS AND METHOD OF MAKING

CONTRACTUAL ORIGIN OF THE INVENTION

The U.S. Government has rights in this invention pursuant to Contract No. W-7405-ENG-82 between the U.S. Department of Energy and Iowa State University, Ames, Iowa.

FIELD OF INVENTION

This invention relates to alloys of copper with refractory metals, and methods of production.

BACKGROUND OF INVENTION

Copper can be alloyed with refractory metals (RM) such as niobium (Nb), vanadium (V), and chromium (Cr) by consumable electrode melting of composite Cu-RM electrodes. The microstructure of the alloys consists of refractory metal dendrites in a copper matrix. For a description of this kind of alloy, see Downing, Verhoeven and Gibson (1987), *J. Appl. Phys.*, 61:2621–2625.

Cu-RM dendrite-type alloys are quite ductile and may be mechanically reduced to very large drawing strains without breakage. Mechanical reduction, such as by drawing, extrusion, or rolling, converts the RM dendrites into elongated filaments which reinforce and greatly increase the strength of the formed wire, sheet, or other solid configuration.

The consumable electrode arc melting method has also been applied to prepare copper-tantalum (Cu-Ta) alloys, as described in U.S. Pat. Nos. 4,481,030 and 4,600,448. A consumable electrode is prepared with a copper matrix having a plurality of RM strips, such as Nb or Ta, embedded therein. The electrode is subjected to direct current arc melting in an enclosed chamber containing an inert gas (e.g., argon). Reduced gas pressure, such as about two-thirds atmosphere, has been employed. The alloy is formed as the tip of the electrode melts, and the resulting alloy melt is collected in a mold to form an ingot.

This consumable electrode arc melting method was found to be applicable to Nb, V, Cr, and Ta. The process conditions employed were essentially the same, and a sub-atmospheric inert gas pressure was used.

In comparing the alloys produced by the consumable electrode arc melting method, it was found that the strength of the alloys formed into wire increased in relation to the shear modulus of the refractory metal. Cu-Ta alloys had strength superior to Cu-Nb alloys, the shear modulus of Ta being about 1.9 times higher than Nb. This finding suggested the need for alloying copper with refractory metals of much higher shear modulus, in particular with molybdenum (Mo) and tungsten (W). The shear modulus of Mo and W are 3.3 and 4.0 times higher than Nb. Further, such Cu-Mo and Cu-W alloys can be expected to have the same type of phase equilibria with Cu, and the same drawing characteristics as Cu-Nb or Cu-Ta alloys. But despite these expectations, prior to the method improvement of the present invention, it was not found possible to prepare such high strength alloys by the consumable electrode arc melting method.

SUMMARY OF INVENTION

This invention is based in part on the discovery of the reason that Cu-Mo alloys could not previously be prepared by the consumable electrode arc melting method. This discovery involved an analysis of the way in which refractory metals become melted and alloyed at the tip end of the consumable electrode. The two phase nature of the consumable electrode comprised, in effect, a new condition, being different than that involved in electrode reactions occurring during vacuum arc remelting of metals.

By observing the form of the lower ends of the composite electrodes following their use in the consumable electrode method, it was found that the strips of the refractory metal protrude from the tip end of the electrode face by a variable distance (X). The copper matrix is recessed in the form of cavities between the tips of RM strips. Apparently because of its lower melting point, the Cu matrix melts back further from the hot arc than the refractory metal inserts. Hence, the RM strips protrude by the X distance. Three metals tested, Ta, Nb and V melt, respectively, at 2996° C., 2468° C., and 1900° C. Experiments on Cu-20 vol. % RM alloys of these metals gave quantitative values of X of 2.2, 1.6 and 0.6 cm-, respectively, for Cu-Ta, Cu-Nb, and Cu-V alloys. This relationship of the X values is such that the protrusion distance is seen to increase in relation to increasing melting points of the refractory metals. These experiments were carried out under an argon atmosphere of approximately 0.7 Atm.

Further analysis indicated that the alloying of Cu-RM occurs directly on the surface of the electrode between the protruding strips of RM. Liquid alloy flows down over the tips of the RM strips, dissolving the RM at a temperature well below its melting point. The tip temperature of the protruding electrode is thereby reduced to around the liquidus temperature of the specific Cu-RM alloy. For example, for a 20 vol. % Cu-Nb alloy the liquidus temperature is about 1680° C., which is 788° C. below the Nb melting point. For the corresponding Cu-Ta alloy, the tip temperature was reduced by over 1000° C. below the Ta melting point.

After further study, a conception of how a Cu-Mo or Cu-W alloy could be prepared was arrived at. Although an experimentally determined phase diagram for Cu-Mo was not available, it appeared from a theoretical phase diagram of the Cu-Mo alloy system that the required tip temperature of the composite electrode would be above the boiling point of copper. It was concluded that if liquid copper is first boiled on the tip of the electrode it would probably have two undesirable consequences. First, Cu boiling could interfere with alloy mixing on the electrode; and, secondly, the vaporized Cu could affect the stability of the arc. From these conclusions about the nature of the problem, it seemed possible that the consumable electrode would be made operable for Cu-Mo and Cu-W alloys by increasing the inert gas pressure around the electrode to a pressure sufficient to fully suppress boiling of the Cu. Experimental tests confirmed that the use of an over-pressure of 0.9 atmospheres permitted Cu-Mo alloying to occur while maintaining arc stability.

In practicing this method, the liquidus temperature is determined, either experimentally or theoretically, for the particular alloy being prepared. The vapor pressure of Cu at that temperature is then obtained from vapor pressure data for liquid copper. That vapor pressure (in atmospheres) is then used as the base pressure for determining the operative pressures to be used. It has been found desirable to utilize an inert gas pressure equal to the vapor pressure of the copper at the alloy liquidus temperature plus at least 0.5 to 0.6 atmospheres.

THE DRAWINGS

The accompanying drawings will be referred to in describing the method of this invention.

DETAILED DESCRIPTION

This invention is preferably practiced with essentially pure copper, molybdenum and tungsten, viz. of at least 99.9% purity. The copper matrix may be cast in the form of an elongated electrode, which may have a circular or rectilinear cross-section. The Cu matrix may be molded with slots into which the refractory metal strips are inserted, or such slots can be milled in the Cu matrix. The refractory metal can be formed in strips for insertion in the slots. At least two insert strips are preferably employed. Depending on the cross-sectional size of the electrode, a larger number of inserts may be used, such as 4 to 6 inserts arranged in a symmetrical pattern. The strips can be secured in the slots by a suitable attachment, such as press-fit or pinning. The amount of the refractory metal embedded in the copper matrix will determine the proportion of Cu to RM of the alloy being prepared. Proportions from as little as 2% by volume up to 50% of the refractory metal can be used. More typically, preferred proportions are in the range of 10–30 vol. % RM.

In carrying out the method, the consumable composite electrode is subjected to direct current arc melting within an enclosed chamber containing an inert gas, such as argon or helium. During the alloying, the inert gas is maintained at a superatmospheric pressure sufficient to prevent boiling of copper under the temperatures generated.

Figure 1:
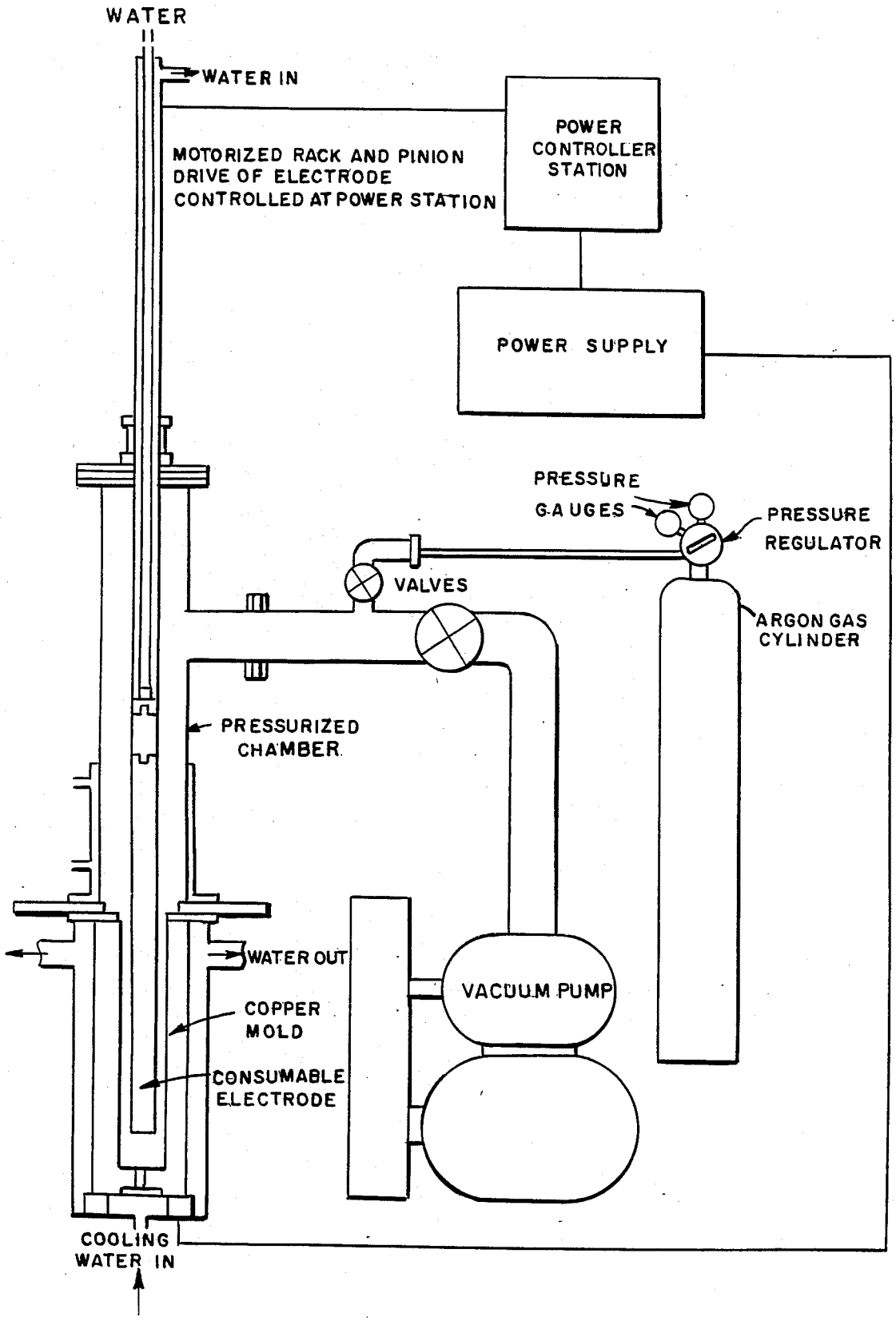
FIG. 1 is a diagrammatic elevational view of a consumable electrode arc welding apparatus, which may be used in practicing the invention.

An illustrative apparatus for carrying out the alloying method is shown diagrammatically in FIG. 1. The consumable electrode is positioned within a water-cooled copper mold. The upper end of the electrode is detachably connected to a motorized rack and pinion drive which is controlled at suitable power station. Appropriate electrical connections are provided to establish the direct current arc. A power supply is provided in conjunction with the electrical connections. The pressurized chamber surrounding the electrode communicates with the open top of the mold, and is connected to a suitable source of argon gas under pressure. There is also a vacuum pump connection for evacuating the chamber prior to the introduction of the pressurized gas.

Figure 2:
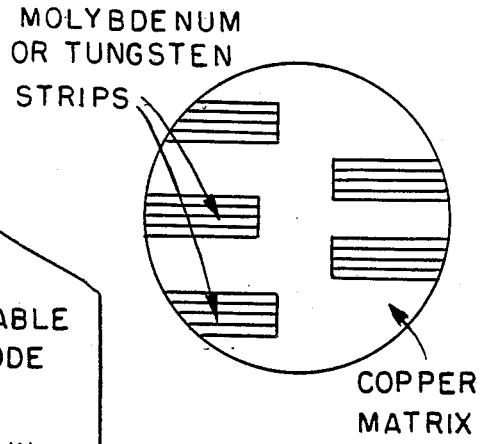
FIG. 2 is an enlarged fragmentary view of the apparatus of FIG. 1, illustrating the appearance of the consumable electrode as the method is being carried out.
Figure 3:
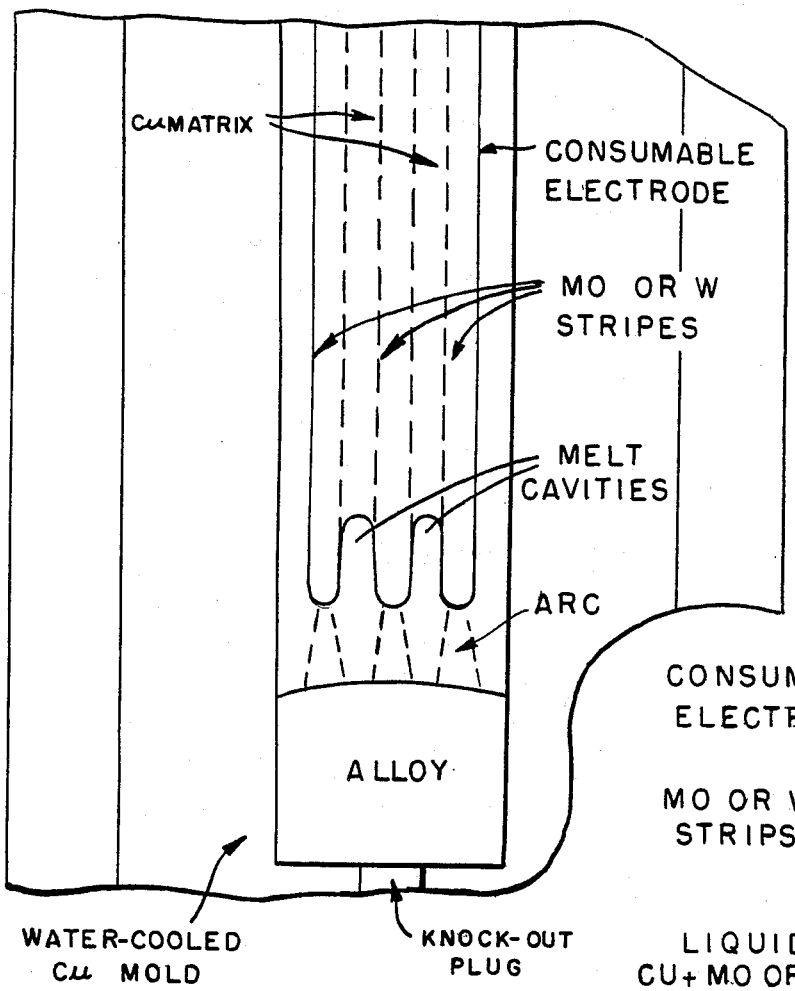
FIG. 3 is an enlarged view of a portion of the electrode tip during alloy forming.

The operation of the alloying method is illustrated more particularly in FIGS. 2 and 3. Looking first at FIG. 2, the consumable electrode is shown as it appears during the formation of the alloy. Following start-up of the electrode, melt cavities form as shown in FIG. 2, and the RM strips form the tip end projections of the electrode. Steady state operation is achieved where the melt cavities ad RM strip projection maintain approximately the same relationship as the alloying proceeds. The arc, as indicated in FIG. 3, generates intense heat at the tips of the refractory metal strips. As the alloyed melt falls downwardly from the electrode into a water-cooled copper mold it is progressively converted to a solid ingot. As the alloy builds up in the mold, the electrode is advanced at a rate so that the arc is maintained at an approximately uniform distance between the electrode tip and the upper surface of the alloy.

Figure 4:
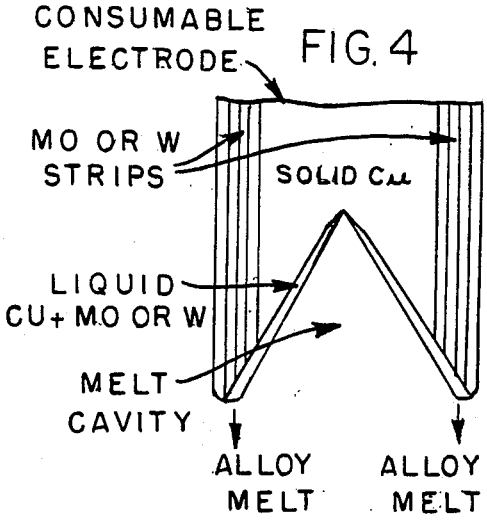
FIG. 4 is an end view showing a composite electrode configuration which may be used.

In FIG. 4, the way in which the alloy melt is formed is more specifically indicated. As copper melts around the center of the melt cavity, it flows downwardly along the inside surfaces of the Mo or W strips and the RM is progressively dissolved. The alloy first formed will be of lower or intermediate composition to that finally produced. The concentration of the Mo or W in the alloy melt increases as it moves downwardly toward the tip of the electrode. At the tip of the electrode, comprising the lower ends of the Mo or W strips, the temperature is sufficient to liquify the alloy of the desired composition. This is the liquidus temperature, and comprises the maximum temperature generated on the electrode.

FIG. 2 shows an end view of a representative composite electrode. In this embodiment, the electrode is of circular cross-section, and has five molybdenum or tungsten inserts embedded in its copper matrix.

Figure 5:
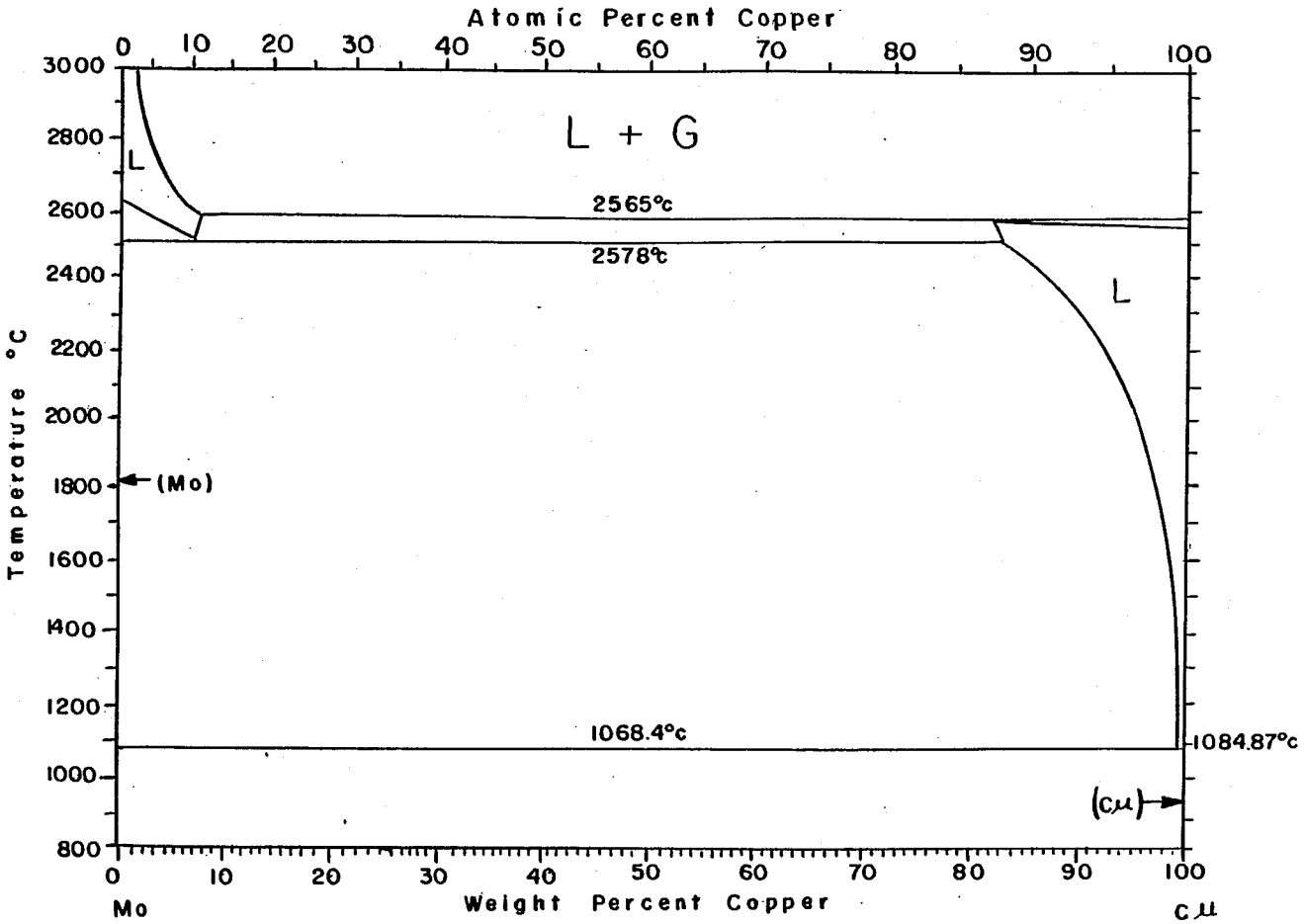
FIG. 5 is a calculated Cu-Mo phase diagram.

During the alloying operation, the pressure of the inert gas surrounding the electrode should be at a superatmospheric pressure sufficiently above the vapor pressure of copper at the tip or liquidus temperature to fully suppress boiling of liquid Cu. To estimate the required pressure for continuous steady state operation, the liquidus temperature of the specific Cu-Mo or Cu-W alloy is determined. This may be done experimentally or theoretically by calculation. For example, FIG. 5 represents a calculated Cu-Mo phase diagram from which a calculated liquidus temperature can be obtained. For alloys of less than 15.2 vol. % Mo (17.0 wt. % Mo) the liquidus temperature is given by the downward sloping line at the right of the diagram, whereas for alloys of greater than 15.2 vol. % the alloy melting temperature is constant at 2515° C.

Figure 6:
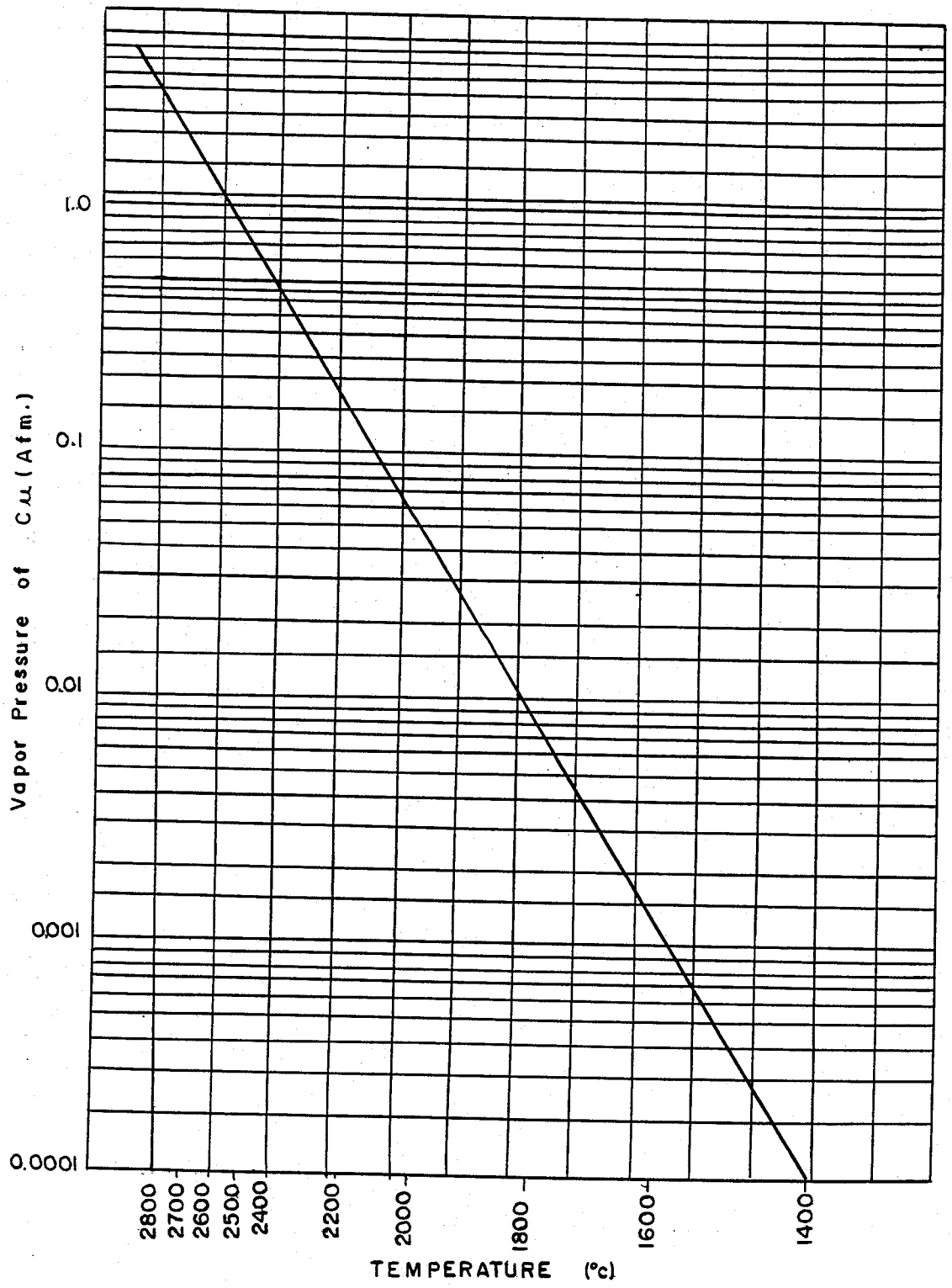
FIG. 6 is a plot of Cu vapor pressures over temperatures corresponding to the liquidus temperatures.

Once the liquidus temperature for the alloy being prepared has been determined or estimated, the next step is to obtain the vapor pressure of copper at that liquidus temperature, such as from a handbook of metal vapor pressures. An illustrative vapor pressure diagram is shown in FIG. 6 for copper.

It has been found preferable to employ an inert gas pressure around the electrode equal to the vapor pressure of the copper at the liquidus temperature (in atmospheres) plus at least 0.5 to 0.6 atmospheres. Higher pressures can be used but it will usually not be necessary to employ total pressure greater than 2 to 3 atmospheres. For example, the operating pressure may equal the vapor pressure of copper at the liquidus temperature of the alloy plus 0.5 to 1.5 atmospheres.

Alloy ingots produced by the method of this invention are believed to be novel compositions of matter. They are essentially homogeneous alloys which contain the molybdenum or tungsten in the form of dendrites.

The alloys are highly ductile and malleable, and they can be readily subjected to size reduction, such as by drawing or rolling, to convert the Mo and W dendrites into elongated filaments, thereby providing greater increased tensile strengths.

Specific directions for use in practicing the method of this invention are set out in the following examples.

EXAMPLE I

Determination of Liquidus Temperature

A procedure for determining the melting point or liquidus temperature of Cu-X alloys, where X=Mo or W, is as follows. A rod of the X alloy is drilled along its axis from one end thereby forming a hole with a bottom at one end. Pure Cu is placed against the bottom end of the hole and a disk of the X metal is placed over the open end of the hold. The assembly is placed in an electron beam welder and the disk is welded to the cylinder. The assembly is then heated to some temperature T in a controlled atmosphere furnace, such as a tungsten mesh, an induction, or an electron beam heated furnace. After holding for 15 minutes to 1 hour the assembly is cooled. A longitudinal section is made through the midplate of the assembly which is metallographically polished and examined by optical microscopy. The volume fraction of the dendritic X material is determined by quantitative metallography which then gives the liqudus composition at the temperature T. This procedure was carried out on Cu-Mo alloys and it was found that the liquidus temperature/composition values were 2000° C./wt. % Mo $=\simeq 2$ and 2300° C./wt. % Mo $\simeq=10$. These values agree well with the calculated phase diagram shown as FIG. 5. The liquidus temperature for a given % W in a Cu-W alloy can be determined by the same procedure.

EXAMPLE II

Determination of Inert Gas Pressure

The minimum pressure required to avoid boiling of the Cu will be the vapor pressure of the Cu in the molten alloy at the top of the electrode, at which point the temperature should correspond to the liquidus temperature. This vapor pressure may be closely estimated from the vapor pressure of pure Cu which is given in FIG. 6. The liquidus temperature for the Cu-X alloys is determined as described above. For example, in a Cu-20 vol. % Mo alloy the tip temperature is estimated to be 2515° C. from FIG. 5 or experimentally determined as also described above. The vapor pressure of Cu at 2515° C. is found from FIG. 6 to be 0.8 Atm. In order to avoid evolution of Cu by boiling it is necessary to keep the internal pressure at some higher value than the vapor pressure of Cu. An operative overpressure may be estimated from previous experiments on Cu-Nb alloys. For a Cu-Nb alloy with a liquidus temperature of 1800° C. successful experiments were carried out with a total internal inert gas pressure of 0.7 Atm. The Cu vapor pressure at 1800° C. is found from FIG. 6 to be 0.08 Atm. For the Cu-20% Mo alloy a usable overpressure is therefore $0.8+0.62=1.42$ Atm. Usable pressures for other Cu-Mo or Cu-W alloys can be estimated in the same manner.

We claim:

1. In a method of preparing an alloy of copper (Cu) and a refractory metal (RM) in which the lower end of an elongated consumable electrode is subjected to direct current arc melting within an enclosed chamber containing an inert gas, said electrode having a Cu matrix with a plurality of RM strips embedded longitudinally therein, wherein the improvement comprises selecting said RM from the group consisting of molybdenum and tungsten, incorporating in said electrode from 2 to 50 volume percent of said RM, and during said arc melting maintaining a superatmospheric inert gas pressure in said chamber sufficiently above the vapor pressure of Cu at the liquidus temperature of the alloy being formed effectively to suppress boiling of liquid Cu, and preparing an ingot of said alloy from the melt produced by aid electrode.

2. The method of claim 1 in which said refractory metal is molybdenum.

3. The method of claim 1 in which said refractory metal is tungsten.

4. The copper-refractory metal alloy ingot produced by the method of claims 1, 2, or 3 containing from 2 to 50 volume percent of molybdenum or tungsten.

5. In a method of preparing an alloy of copper (Cu) and a refractory metal (RM) in which the lower end of an elongated consumable electrode is subjected to direct current arc melting within an enclosed chamber containing an inert gas, said electrode having a Cu matrix with a plurality of RM strips embedded longitudinally therein, wherein the improvement comprises selecting said RM from the group consisting of molybdenum and tungsten, incorporating in said electrode from 5 to 39 volume percent of said RM, and during said arc melting maintaining an inert gas pressure in said chamber equal to the vapor pressure in atmosphere of Cu at the liquidus temperature of the alloy being formed plus 0.5 to 1.5 atmospheres, and preparing an ingot of said alloy from the melt produced by said electrode.

6. The method of claim 5 in which said refractory metal is molybdenum.

7. The method of claim 5 in which said refractory metal is tungsten.

8. The copper-refractory metal alloy ingot produced by the method of claims 5, 6, or 7, said ingot being essentially homogeneous and containing from 5 to 30 volume percent of molybdenum or tungsten in the form of dendrites.

* * * * *

UNITED STATES PATENT AND TRADEMARK OFFICE

CERTIFICATE OF CORRECTION

PATENT NO. : 4,832,738

DATED : May 23, 1989

INVENTOR(S) : Frederick A. Schmidt, et al.

It is certified that error appears in the above-identified patent and that said Letters Patent is hereby corrected as shown below:

In claim 1, line 24, change "aid" to --said--

Signed and Sealed this

Sixteenth Day of January, 1990

*Attest:*

JEFFREY M. SAMUELS

*Attesting Officer*

*Acting Commissioner of Patents and Trademarks*